United States Patent [19]

Marsh

[11] Patent Number: 4,544,465

[45] Date of Patent: Oct. 1, 1985

[54] GALVANIC ANODES FOR SUBMERGIBLE FERROUS METAL STRUCTURES

[75] Inventor: Glenn A. Marsh, Fullerton, Calif.

[73] Assignee: Union Oil Company of California, Los Angeles, Calif.

[21] Appl. No.: 545,533

[22] Filed: Oct. 26, 1983

[51] Int. Cl.[4] ..... C23F 13/00

[52] U.S. Cl. ..... 204/148; 204/197; 204/286; 204/297 R

[58] Field of Search ..... 204/147, 148, 196, 197, 204/286, 297 R

[56] References Cited

U.S. PATENT DOCUMENTS

| | | | |
|---|---|---|---|
| 1,664,800 | 4/1928 | Mills | 204/197 |
| 2,802,781 | 8/1957 | Featherly | 204/197 |
| 2,809,932 | 10/1957 | Abt | 204/197 |
| 2,870,079 | 1/1959 | McCall | 204/197 |
| 2,947,680 | 8/1960 | Preiser | 204/197 |
| 3,037,926 | 6/1962 | Ambler | 204/197 |
| 3,491,012 | 1/1970 | Winslow | 204/404 |
| 3,616,418 | 12/1969 | Anderson et al. | 204/196 |
| 3,739,456 | 6/1973 | Scherer et al. | 204/197 |
| 3,870,615 | 3/1975 | Wilson et al. | 204/197 |
| 3,992,272 | 11/1976 | Maxson et al. | 204/147 |
| 4,017,370 | 4/1977 | Wootten | 204/147 |
| 4,038,168 | 7/1977 | Higuchi et al. | 204/197 |
| 4,045,320 | 8/1977 | Klingenberg | 204/197 |
| 4,056,446 | 11/1977 | Vennert | 204/147 |
| 4,123,338 | 10/1978 | Wootten | 204/147 |
| 4,175,021 | 11/1979 | Tatum et al. | 204/196 |
| 4,201,637 | 5/1980 | Peterson et al. | 204/148 |
| 4,292,149 | 9/1981 | Warne | 204/147 |
| 4,298,445 | 11/1981 | Warne | 204/196 |
| 4,309,263 | 1/1982 | Boyd | 204/197 |
| 4,318,787 | 3/1982 | Peterson et al. | 204/147 |
| 4,400,259 | 8/1983 | Schutt | 204/196 |
| 4,401,540 | 8/1983 | Tatum et al. | 204/196 |
| 4,415,293 | 11/1983 | Engel et al. | 204/197 |

FOREIGN PATENT DOCUMENTS

| | | | |
|---|---|---|---|
| 1922151 | 11/1970 | Fed. Rep. of Germany | 204/147 |
| 996343 | 12/1963 | United Kingdom | 204/197 |

OTHER PUBLICATIONS

Shrimp, "Corrosion Prevention for Offshore Platform", (Apr. 1984), pp. 605–608.

Hedborg, "Corrosion in the Offshore Environment", (1974), pp. 253–260.

*Primary Examiner*—T. Tung

*Attorney, Agent, or Firm*—Robert J. Baran; Gregory F. Wirzbicki; Dean Sandford

[57] ABSTRACT

This invention provides a detachable sacrificial anode unit comprising a rigid core, e.g. a tubular steel member, and a body of sacrificial anode material, e.g. metals and alloys including zinc, aluminum and magnesium, surrounding and supported by said rigid core, wherein the ends of said rigid core extend beyond the ends of the body of sacrificial anode material, and are adapted to be coupled to the end of another sacrificial anode unit to provide a rigid string.

This invention also provides a submergible ferrous metal structure useful in a salt water environment and having a system to provide galvanic protection to the ferrous metal which system comprises a vertically oriented, rigid string of such sacrificial anode units secured to each other by threaded couplings and electrically connected at the ends thereof to such structure in a manner to provide galvanic protection to said structure.

20 Claims, 2 Drawing Figures

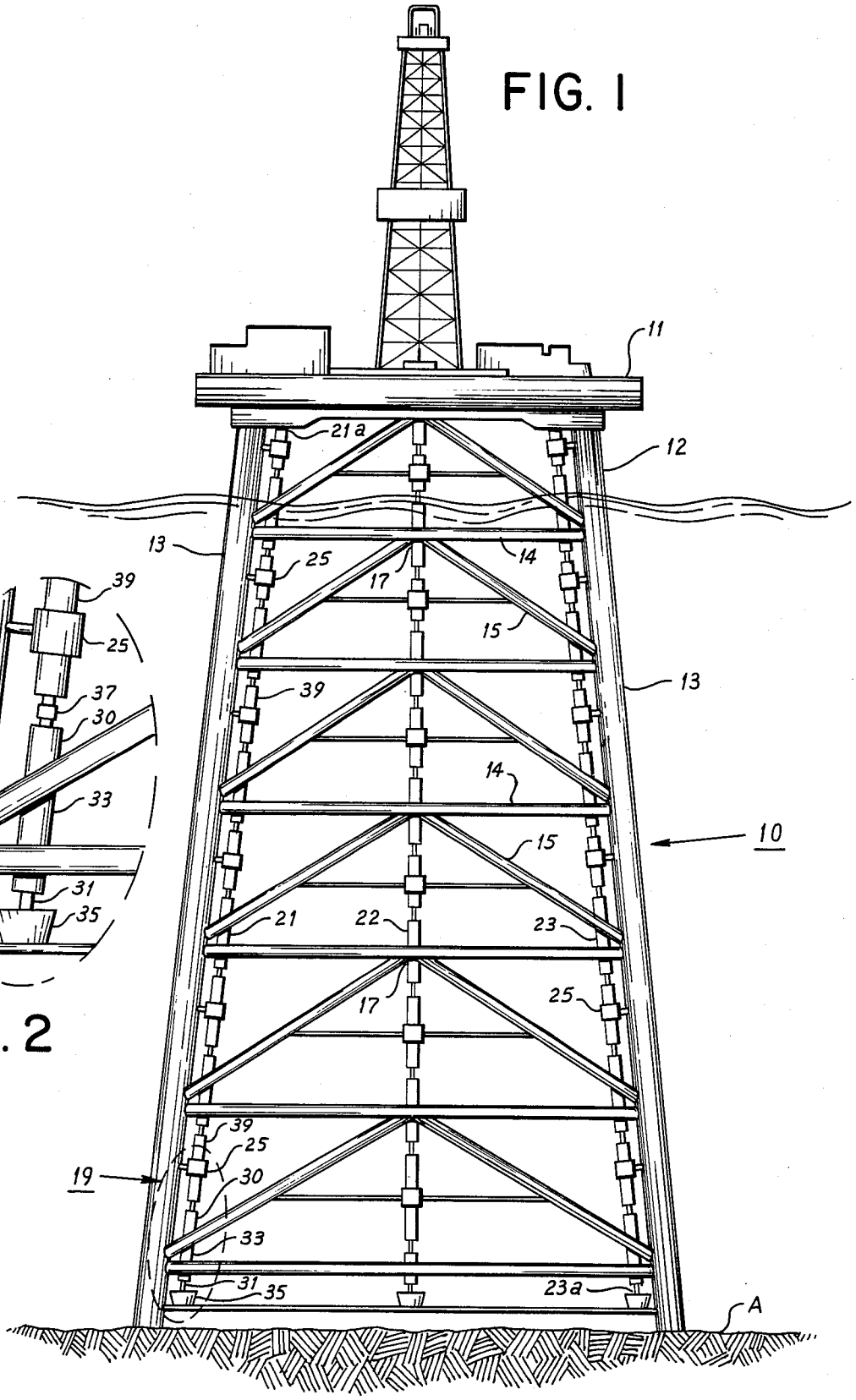
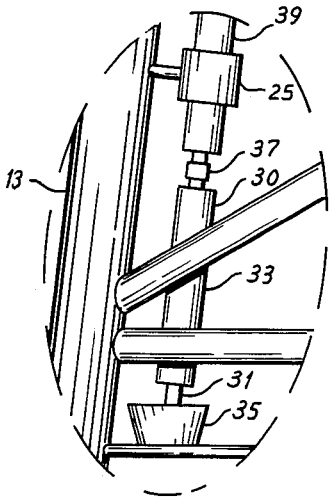
FIG. 2

GALVANIC ANODES FOR SUBMERGIBLE FERROUS METAL STRUCTURES

BACKGROUND OF THE INVENTION

1. Field of the Invention

This invention relates to improved galvanic or sacrificial anodes that are useful in providing corrosion protection to submerged ferrous metal structures, e.g. offshore drilling platforms, and can be installed and replaced without the aid of a diver.

2. Background of the Art

It is well known that various metal structures used in corrosive environments such as salt water (ocean) must be provided with protection from corrosion. This protection may be provided by utilizing sacrificial anodes or impressed current anodes. Impressed current anodes are of two types, consumable and inert. The consumable anodes may be fabricated from scrap iron. The inert anodes are usually comprised of a platinum group material supported on titanium, niobium, or other film-forming metal. All impressed current anodes require a source of direct current to make the anode effective to provide cathodic protection to the metal structure. While impressed current anodes have some advantages, e.g. they can be driven at a high current output per anode, they also have disadvantages. They require onboard electric power or a power cable running from shore. The anodes are expensive to install and difficult to arrange so as to achieve good current distribution. Also, the anodes and interconnecting cables are vulnerable to damage.

Sacrificial anodes function by corroding in the marine environment in place of the metal structure. It is known that the cathodic protection provided by sacrificial anodes will last for a time dependent on the number and size of the anodes; when the sacrificial anodes have corroded to the end of their useful life, the sacrificial anodes must be replaced. The replacement of sacrificial anodes is a difficult task and usually requires divers to descend into the water and secure replacement sacrificial anodes to the metal structure. This is a very expensive procedure and divers cannot operate at depths much below about 300 feet.

Various workers in the field have attempted to provide sacrificial anodes which can be easily replaced and do not require a diver to enter the water for such replacement, for example, see U.S. Pat. No. 2,870,079 which describes a string of detachable sacrificial anodes linked to each other by a flexible cable. In use, the sacrificial anode string is oriented substantially horizontally and thus would not be effective in providing protection along the vertical of a support or leg of a metal structure used in marine environments. It is clear that a flexible string would not be as suitable as a rigid structure in that wave action or ocean currents can move the sacrificial anodes away from the metal structure that is to be protected, and it is known in the art that a certain spacing between the sacrificial anode and the structure to be protected must be maintained for adequate corrosion prevention. Furthermore, this string would not be easily secured in a precise location even by means of guides, in the absence of a diver, since by the flexible nature thereof, the wave action of the marine environment will move the string away from a precise location during installation.

U.S. Pat. No. 3,037,926 also teaches a method for providing cathodic protection on the horizontal for the interior surfaces of ships, i.e., tankers. The sacrificial anode is formed on a rod which is connected by a flexible cable to a ship. This reference does not teach that the string of sacrificial anodic material would be useful in providing galvanic protection to a submerged marine structure, and moreover, for the same reasons as given above for the flexible string described in U.S. Pat. No. 2,870,079, it would not be useful in providing corrosion protection to a marine structure, at a precise location, unless installed by a diver.

U.S. Pat. No. 4,298,445 teaches a method of providing cathodic protection by use of an impressed current anode. This reference discloses the use of a retractable anode; however, the anode disclosed therein is clearly taught as useful only as an impressed current anode. In view of the metal utilized in fabricating the anode of this reference (a platinum group metal coated on titanium or niobium), this anode would not be useful in providing cathodic protection unless a direct current was applied thereto to make such anode of the correct EMF to provide cathodic protection to the metal structure to which it was affixed.

U.S. Pat. No. 4,045,320 teaches a galvanic anode having an active material cast onto a metal support wherein said support comprises an expandable network of metal bound to at least one side of the anode or active material to hold said active material to the support metal. This reference is relevant in showing sacrificial anodes; however, as with the prior art, these anodes must be individually secured to the marine structure, by a diver.

U.S. Pat. No. 3,870,615 teaches a sacrificial anode having a one-piece pipe core of steel in a body of sacrificial anode material surrounding and supported by the central section of said pipe. This sacrificial anode is individually secured to the structure and thus would have to be replaced after use by a diver descending to the depth at which it is located and welding a replacement anode to the structure at that point.

U.S. Pat. No. 4,292,149 teaches an impressed current anode which includes an elongated electrode of platinized titanium or niobium helically wound around a rope. This reference provides a flexible impressed current anode. Moreover, it is clearly pointed out that a diver must be utilized to anchor the downwardmost portion of the anode to the structure which is being protected thereby.

U.S. Pat. No. 3,616,418 teaches an anode assembly for cathodic protection of submerged supporting legs of off-shore platforms. This anode comprises an elongated carrier cable which may be secured to the platform to span the space between the submerged legs thereof and carries an elongated anode along the length of the cable intermediate its ends. This reference also teaches an impressed current anode which is utilized in a horizontal mode. For the same reasons as discussed above for flexible systems of this sort, this particular anode structure would not be useful in providing vertical galvanic protection to a submerged marine structure.

U.S. Pat. No. 4,056,446 teaches a method to measure the cathodic protection along the height of a vertical platform sitting on the ocean floor. This reference teaches a cable apparatus which is utilized to move a reference electrode along the vertical to measure the cathodic protection at any point above the floor of the ocean. This reference is relevant in showing the concern with maintaining cathodic protection for structures in a marine environment; however, it does not teach the use of sacrificial anodes but is instead concerned with measurement of the protection achieved by any galvanic protection method.

U.S. Pat. Nos. 4,201,637 and 4,318,787 teach a method for replacing anodic material used to provide galvanic protection to a marine structure. In both patents a sacrificial anode type material either as pellets as a thixotropic suspension is passed through a tube into a container located in the vicinity at which cathodic protection is desired. In particular, it may be located where a cross member is secured to a vertical member of the marine structure. The necessary conductivity required to provide galvanic protection is lacking in this reference in that the pellets or dispersed material must be in contact to provide an electrically continuous material. Moreover, in this environment the typical sacrificial anode material such as zinc, aluminum, magnesium or alloys thereof would rapidly convert at the surface to the oxide which is much less reactive and would insulate the particles from each other and so not provide the required galvanic protection.

U.S. Pat. No. 4,309,263 teaches a clamp for securing sacrificial anodes to a marine placement. This clamp overcomes the problems with welding a preformed joint to the platform by providing adjustable clamping means. This reference still requires a diver to go into the depths for replacement of the sacrificial anode.

U.S. Pat. No. 3,992,272 relates to the problem of easily corrodible joints such a where a cross member or brace is joined to a vertical leg of a marine structure. The joint is coated with a concrete material so that corrosion protection in addition to cathodic protection (by an impressed current) is not as critical.

It is thus one object of the instant invention to provide a sacrificial anode that can be attached to a submerged ferrous metal structure without the intervention of divers.

It is another object of the instant invention to provide a corrosion protection system for submerged ferrous metal structure which comprises a plurality of individual, interchangeable units.

It is an object of this invention to provide a system for precisely locating a sacrificial anode in relationship to a portion of a submerged ferrous metal structure without the intervention of a diver.

Other objects and advantages of the instant invention will be apparent from a careful reading of the specification below.

SUMMARY OF THE INVENTION

This invention provides a detachable sacrificial anode unit comprising a rigid core and a body of sacrificial anode material surrounding and supported by said rigid core, wherein the ends of said rigid core extend beyond the ends of the body of sacrificial anode material, and are adapted to be coupled to the end of another sacrificial anode unit to provide a rigid string. The rigid core preferably comprises a tubular steel member, e.g. a threaded steel pipe.

The sacrificial anode material preferably comprises a cylindrical body of metals and alloys selected from the group consisting of zinc, aluminum, and magnesium.

The above detachable sacrificial anode units may be utilized to provide an anode assembly comprising a rigid string of such anode units secured to each other, e.g. by threaded couplings.

The instant invention also provides a submergible ferrous metal structure useful in a salt water environment and having a system to provide galvanic protection to the ferrous metal which system comprises a substantially vertically oriented, rigid string of the above sacrificial anode units secured to each other by threaded couplings and electrically connected at the ends thereof to said structure in a manner to provide galvanic protection to said structure.

The structure may further comprise at least one string guide including a tube having an inner diameter greater than the diameter of said body of sacrificial anode material, to assist in locating the rigid string in a precise location vis a vis the portion of the structure that is to be protected from corrosion. The structure may further comprise a socket for securing the downwardmost end of said rigid string to said structure.

BRIEF DESCRIPTION OF THE DRAWING FIGURE

The invention will be more readily understood by reference to the drawing figure wherein:

FIG. 1 is an elevational view of a preferred embodiment of the submergable ferrous metal structure of this invention and includes a schematic diagram showing a preferred embodiment of the sacrificial anode installed on said structure for the purpose of protection the ferrous metal of said structure from corrosion.

FIG. 2 is a view of a joint of the submergible ferrous metal structure of this invention.

DETAILED DESCRIPTION OF THE INVENTION

A submerged ferrous metal structure shown generally at 10 and having a platform 11 is supported on the floor A of an ocean or other body of water by a ferrous metal supporting structure 12 in a position to drill for oil located beneath such floor. The ferrous metal supporting structure is fabricated from large steel pipes 13, which are substantially vertically oriented and secured to each other in a rigid relationship by a plurality of steel crossmembers, e.g., horizontal members 14 and diagonal members 15. The large steel pipes and said crossmembers are typically joined by welding, but other methods for joining steel pipe may also be used.

The joints of the ferrous metal supporting structure 10 are especially prone to corrosion and corrosion fatigue. The invention therefore provides, as shown in the figure, three strings 21, 22 and 23 of sacrificial anodes, positioned to provide corrosion protection at the various joints of the ferrous metal supporting structure. As shown, strings 21 and 23 are substantially vertically oriented adjacent the steel pipes to provide corrosion protection to the steel pipes especially in the vicinity of the joints 19. One string, 22, is oriented vertically to provide corrosion protection at the joints 17 intermediate said vertical crossmembers at which point the diagonal crossmembers 15 are secured to the horizontal crossmembers. While said strings 21, 22, and 23 are shown in substantially vertical or substantially vertical orientation, due to the length thereof, any of said strings may be curved, by bending, to provide corrosion protection along an axis that is diagonally oriented from a true vertical.

The anode strings are guided into place by passing through string guides 25, which are cylindrical tubes having an inside diameter greater than the outside diameter of the body of sacrificial material 33. (The detachable, sacrificial anode units are shown generally at 30 and comprise a rigid core 31, e.g. a tubular steel member such as a threaded steel pipe, surrounded by a sacrificial anode material 33, which has an EMF higher than the ferrous metal structure and is preferably selected from the group consisting of the metals zinc, aluminum and magnesium, and alloys containing one or more of those metals as principal constituents.) The rigid string of sacrificial anode units may be threaded through a series of string guides to ensure proper orientation and secured to socket 35, located at the foot of steel pipe 13. Socket 35 ensures correct placement of the string of sacrificial anodes and may be utilized to provide galvanic connection of said string to the ferrous metal supporting structure. (The string is also galvanically connected to the ferrous metal supporting structure at the other end thereof (21*a*) to provide operable corrosion protection to the ferrous metal supporting structure.)

As shown in the Figure, one or more insulating spacers 39 may be used in place of the detachable sacrificial anode units. The insulating spacers are positioned where the anode string is in the vicinity of a portion of the submerged structure that does not require the degree of corrosion protection that the welded joints require. Conveniently the insulating spacer comprises an insulating material cast or molded on a rigid core, e.g. a threaded steel pipe. The rigid core provides electrical conductivity between the portions of the string above and below the insulating spacer. Preferably the cross sectional dimension of the insulating material is equivalent to the cross sectional dimension of the sacrificial anode material so that the string including insulating spacers may be easily passed through the string guides.

The insulating material may be a suitable thermoplastic or rubber, e.g. polyethylene and, for durability, preferably a fiber glass filled polyester. Alternatively a steel jacket may be placed around the insulating material to provide resistance to abrasive wear.

It will be apparent to one skilled in the art that, while there is no problem in fabricating or attaching the conventional cast aluminum anodes, there is a problem in either modifying an existing sacrificial anode system on an offshore platform or in replacing exhausted anodes. At present, there is no way other than utilizing divers or remotely controlled submersible vessels to remove existing anodes or install new ones, to provide vertical or substantially vertical protection, with the conventional system. In the instant invention, the installation, modification, or replacement of anodes on the offshore platforms is simplified. At the time the platform jacket is constructed, the guides 25 are installed to permit the anode string to be placed at the proper intervals both in plane view and in cross section.

The instant invention provides a very flexible system for protecting a submerged ferrous metal structure from corrosion. For example, the anode dimensions (length, diameter) and the coupling length may be chosen to give the desired current density of the cathodic protection system and desired life time of the anodes. Typically the sacrificial anode units (including the rigid core) may vary from 6 to 12 inches in diameter and 6 to 12 feet in length. Varying the coupling length or replacing one or more of the sacrificial anode units with an insulating spacer allows spacing of the sacrificial anodes adjacent the joint portions of the ferrous metal structure if such spacing is desired. Moreover, the sacrificial anode units are interchangeable and may be assembled into an anode string having a length of 200 foot or more, e.g. 400 foot or more; to provide corrosion protection at a depth greater than may be reached with divers. Thus the instant system permits replacement of sacrificial anodes in any water depth. Using the present conventional methods. replacement is limited to just a few hundred feet of water depth by divers and is exceedingly difficult if remotely operated means must be used. Finally, if it is desired to revamp the system or replace the anodes, this could be readily done by moving a derrick over the strings of anodes and removing the strings and then replacing them.

Another benefit of the instant invention is that the anodes may be added after the supporting structure is placed on bottom. Thus, the anodes do not contribute weight to the supporting structure during tow-out and launch of the supporting structure.

The instant system also permits great flexibility; for example, if it is found that the bottom $\frac{1}{3}$ of a string has only marginal protection, the anode strings can be retrieved and revised and then placed back in position, adding additional anodes in the lower part of the structure.

The connection of the individual sacrificial anode units to provide a string is illustrated in the expanded portion of the figure. For example, a threaded steel pipe 31 supports a sacrificial anode material 33. The sacrificial anode material may be joined to the steel pipe by means known in the art, e.g. by casting of molten alloy or metal. Separate anode units 30 are connected by means of threaded couplings 37 to provide a rigid, but bendable string. As shown, the sacrificial anode 30 is located adjacent to a joint 19 of the ferrous metal supporting structure, a point at which corrosion protection is critical.

While particular embodiments of the invention have been described it will be understood of course that the invention is not limited thereto. Since many obvious modifications can be made, it is intended to include within this invention any such modifications as will fall within the scope of the intended claims.

Having now described the invention I claim:

1. A submergible ferrous metal structure useful in a salt water environment and having a system to provide galvanic protection to the ferrous metal which system comprises a substantially, vertically oriented, rigid string of anode units, each anode unit comprising a rigid core and a body of sacrificial anode material surrounding and supported by said rigid core, wherein the ends of said rigid core extend beyond the ends of the body of sacrificial anode material, and are each adapted to be coupled to the end of another similar sacrificial anode unit to provide said rigid string, and said string being electrically connected at at least one end to said structure in a manner to provide galvanic protection to said structure and further comprising a plurality of string guides, affixed to said ferrous metal structure, each of said string guides comprising a tube having an inner diameter greater than the diameter of said body of sacrificial anode material and having a length substantially less than the length of said string of anode units and, within said string, one or more insulating spacers, said insulating spacer comprising insulating material, having a cross sectional dimension substantially similar to the cross sectional dimension of said sacrificial anode material, and cast or molded on a rigid core that is capable of providing electrical conductivity between the portions of the string above and below said insulating spacer, said string of anode units extending through said string guides.

2. The submergible ferrous metal structure of claim 1 wherein said rigid core comprises a tubular steel member.

3. The submergible ferrous metal structure of claim 1 wherein said sacrificial anode material comprises a cylindrical body and is selected from the group consisting of zinc, aluminum, and magnesium, and alloys in which either zinc, aluminum, or magnesium, or any combination of them, is a major constituent.

4. The submergible ferrous metal structure of claim 1 wherein the ends of the said rigid core are threaded.

5. The submergible ferrous metal structure of claim 1 wherein said anode units are secured to each other by threaded couplings.

6. The structure of claim 1 further comprising a socket for securing the downwardmost end of said rigid string to said structure.

7. The submergible ferrous metal structure of claim 1 wherein said string of anode units has a length of 400 feet or greater.

8. A submerged, ferrous metal structure supported on the floor of an ocean or other body of water, and having a system to provide galvanic protection to the ferrous metal which system comprises a substantially vertically oriented, rigid string of anode units, each anode unit comprising a rigid core and a body of sacrificial anode material surrounding and supported by said rigid core, wherein the ends of said rigid core extend beyond the ends of the body of sacrificial anode material, and are each adapted to be coupled to the end of another similar sacrificial anode unit to provide said rigid string, and said string being electrically connected at at least one end to said structure in a manner to provide galvanic protection to said structure and further comprising a plurality of string guides, affixed to said ferrous metal structure, each of said string guides comprising a tube having an inner diameter greater than the diameter of said body of sacrificial anode material and having a length substantially less than the length of said string of anode units and, within said string, one or more insulating spacers, said insulating spacer comprising insulating material, having a cross sectional dimension substantially similar to the cross sectional dimension of said sacrificial anode material, and cast or molded on a rigid core that is capable of providing electrical conductivity between the portions of the string above and below said insulating spacer, said string of anode units extending through said string guides.

9. The submerged ferrous metal structure of claim 8 wherein said rigid core comprises a tubular steel member.

10. The submerged ferrous metal structure of claim 8 wherein said sacrificial anode material comprises a cylindrical body and is selected from the group consisting of zinc, aluminum, and magnesium, and alloys in which either zinc, aluminium, or magnesium, or any combination of them, is a major constituent.

11. The submerged ferrous metal structure of claim 8 wherein the ends of said rigid core are threaded.

12. The submerged ferrous metal structure of claim 8 wherein said anode units are secured to each other by threaded couplings.

13. The submerged ferrous metal structure of claim 8 further comprising a socket for securing the downwardmost end of said rigid string to said structure.

14. The submerged ferrous metal structure of claim 8 wherein said string of anode units has a length of 400 feet or greater.

15. A method for providing galvanic protection to a submerged ferrous metal structure, in a salt water environment, which comprises providing a substantially, vertically oriented, rigid string of anode units and one or more insulating spacers, each anode unit and insulating spacer comprising a rigid core and said anode unit comprising a body of sacrificial anode material and said insulating spacer comprising insulating material, said sacrificial anode material and said insulating material surrounding and being supported by said rigid core, wherein the ends of said rigid core extend beyond the ends of the body of sacrificial anode material and insulating material and each end being adapted to be coupled to the end of another similar sacrificial anode unit or an insulating spacer to provide said rigid string; passing said rigid string through a plurality of string guides affixed to said ferrous metal structure; and electrically connecting at least one end of said string to said structure in a manner to provide galvanic protection thereto.

16. The method of claim 15 wherein said rigid core comprises a tubular steel member.

17. The method of claim 16 wherein the ends of the said rigid core are threaded.

18. The method of claim 17 wherein said anode units are secured to each other by threaded couplings.

19. The method of claim 16 wherein said string of anode units has a length of 400 feet or greater.

20. The method of claim 15 wherein said sacrificial anode material comprises a cylindrical body and is selected from the group consisting of zinc, aluminum, and magnesium, and alloys in which either zinc, aluminum, or magnesium, or any combination of them, is a major constituent.

* * * * *